US007801320B2

(12) United States Patent
Mellow

(10) Patent No.: US 7,801,320 B2
(45) Date of Patent: Sep. 21, 2010

(54) SOUND SPONGE FOR LOUDSPEAKERS

(75) Inventor: Tim Mellow, Farnham (GB)

(73) Assignee: Nokia Corporation, Espoo (FI)

( * ) Notice: Subject to any disclaimer, the term of this patent is extended or adjusted under 35 U.S.C. 154(b) by 1100 days.

(21) Appl. No.: 11/373,825

(22) Filed: Mar. 9, 2006

(65) Prior Publication Data

US 2007/0223776 A1 Sep. 27, 2007

(51) Int. Cl.
*H04R 25/00* (2006.01)

(52) U.S. Cl. ..... 381/338; 381/348; 381/354

(58) Field of Classification Search ..... 381/337–339, 381/341–344, 346, 348–349, 353–354, 162
See application file for complete search history.

(56) References Cited

U.S. PATENT DOCUMENTS

| | | | | |
|---|---|---|---|---|
| 2,225,312 | A * | 12/1940 | Mason | 381/338 |
| 2,228,886 | A * | 1/1941 | Olson | 381/338 |
| 2,262,146 | A * | 11/1941 | Massa | 381/338 |
| 3,936,606 | A | 2/1976 | Wanke | |
| 4,493,389 | A | 1/1985 | Del Rosario | |
| 5,933,508 | A * | 8/1999 | Fuke et al. | 381/398 |
| 6,952,874 | B2 * | 10/2005 | Button et al. | 381/343 |
| 2001/0026626 | A1 | 10/2001 | Athanas | |
| 2002/0012439 | A1 | 1/2002 | Schafer | |

FOREIGN PATENT DOCUMENTS

| | | |
|---|---|---|
| GB | 626623 | 7/1949 |
| GB | 2329514 | 3/1999 |
| JP | 2005060164 | 3/2005 |

OTHER PUBLICATIONS

"The Virtual Loudspeaker Cabinet", J. R. Wright, J. Audio Eng. Soc. 51(4), 244-247 (2003).

"The propagation of plane sound waves in narrow and wide circular tubes, and generalization to uniform tubes of arbitrary cross-sectional shape", Michael R. Stinson, J. Acoust. Soc. Am. 89(2), 550-558 (1991).

"Theory of Sound" J.W. Strutt, (Lord Rayleigh), Dover, New York, 1945, 2nd ed. vol. II, p. 323-328.

(Continued)

*Primary Examiner*—Suhan Ni
(74) *Attorney, Agent, or Firm*—Ware, Fressola, Van Der Sluys & Adolphson LLP

(57) ABSTRACT

The specification and drawings present a new method and apparatus for reducing loudspeaker size by partitioning the back cavity of the loudspeaker using a sound sponge block. The sound sponge block is an array of narrow ducts (e.g., parallel ducts, or parallel round cylinders of a small diameter) made of a pre-selected material with predetermined dimensions (e.g., the diameter and length) formed within a single block which is placed behind a loudspeaker diaphragm but not in a direct contact with it. The sound sponge block, comprising the multiple very narrow ducts (e.g., with duct diameters on the order of microns) substantially absorbs the sound waves radiated from a rear side of the diaphragm in the backward direction due to significant drop in the impedance for very narrow tube diameters.

10 Claims, 4 Drawing Sheets

Miniature electrodynamic loudspeaker with "sound sponge"

OTHER PUBLICATIONS

"Scattering and absorption by acoustic resonators", U. Ingard, J. Acoust. Soc. Am., 25(6), 1037-1061 (1953).

"Acoustics", Leo L. Beranek, (Acoustical Society of America, New York, 1993), pp. 133-138.

"Sound wave propagation in transition-regime micro-and nanochannels", N. G. Hadjiconstantinou, Phys. Fluids 14(2), 802-809 (2002).

"On the Sound Field of a Membrane in an Infinite Baffle", T. J. Mellow and L. M. Karkkainen, Audio Engineering Society Convention Papers, 118$^{th}$ Convention, Barcelona, May 28-31, 2005.

"Loudspeaker Design", Bradley M. Starobin, Chapter 111, p. 1389-1410.

7 pages EP 07705595.2 Search Report dated May 7, 2010.

JP2005-060164 English Language Abstract.

* cited by examiner

Miniature electrodynamic loudspeaker: prior art

Miniature electrodynamic loudspeaker with "sound sponge"

SOUND SPONGE FOR LOUDSPEAKERS

FIELD OF THE INVENTION

This invention generally relates to the fields of acoustics and audio transducer technology and more specifically to reducing loudspeaker size by improving its performance using a sound sponge.

BACKGROUND ART

New loudspeaker technologies are being considered for use in mobile products which have a number of advantages over the moving coil types currently being used, such as potentially higher efficiency, higher quality or greater flexibility regarding product form factor. However, what most of these have in common is very light flexible diaphragms and therefore would not work with, e.g., sealed-cavity design paradigm, since this would provide too much stiffness and therefore greatly reduce the low frequency output. An open back design would not be satisfactory either since the sound radiated from the rear would partially cancel the sound radiated from the front because the two are in opposite phase. This appears to be a major technology bottleneck.

Thus currently conventional heavy (moving mass) and inefficient moving coil loudspeakers with sealed back cavities are used in mobile products. Light diaphragms are currently only used in hi-fi loudspeakers using the electrostatic or planar magnetic principles, where the diaphragms can be made large enough to counteract the cancellation effects of the rear wave. So called "sound absorbing" materials are used in non-mobile loudspeaker cabinets to control standing waves, but they have little effect at lower frequencies and therefore do not allow the size of the cabinet to be reduced by very much. Such materials include fibrous materials, foams and other porous materials in which the pores are essentially random in size.

DISCLOSURE OF THE INVENTION

According to a first aspect of the invention, a loudspeaker, comprises: a diaphragm for providing an acoustic signal by a way of vibrations from the loudspeaker in forward and backward directions; and a sound sponge block comprising multiple ducts made of a pre-selected material placed behind the diaphragm without physically touching the diaphragm, wherein the multiple ducts have predetermined geometrical dimensions to substantially absorb the sound waves radiated from a rear side of the diaphragm in the backward direction.

According further to the first aspect of the invention, the multiple ducts may be round cylinders. Further, the round cylinders may have a diameter between 0.1 and 10 microns.

Further according to the first aspect of the invention, the ends of the multiple ducts furthest from the diaphragm may be sealed and have an infinite specific termination impedance.

Still further according to the first aspect of the invention, the multiple ducts may be parallel to each other.

According further to the first aspect of the invention, the multiple ducts may be substantially perpendicular to a surface of the diaphragm.

According still further to the first aspect of the invention, a cross section of the multiple ducts may comprise 90% or less of a total cross section area of the sound sponge block.

According further still to the first aspect of the invention, a sound sponge block may have a real part of an acoustic impedance substantially constant in a predetermined frequency range. Further, the frequency range may be from 10 Hz to 10,000 Hz.

According to a second aspect of the invention, an electronic device, comprises: a signal provider, for providing an electric drive signal; and a loudspeaker, responsive to the electric drive signal, for providing an acoustic signal of the electronic device in response to the electric drive signal, wherein the loudspeaker comprises: a diaphragm for providing the acoustic signal by a way of vibrations from the loudspeaker in forward and backward directions; and a sound sponge block comprising multiple ducts made of a pre-selected material placed behind the diaphragm without physically touching the diaphragm, wherein the multiple ducts have predetermined geometrical dimensions to substantially absorb the sound waves radiated from a rear side of the diaphragm in the backward direction.

According further to the second aspect of the invention, the diaphragm may be made of optically transparent material such that the loudspeaker is combined with a display of the electronic device.

Further according to the second aspect of the invention, the electronic device may be a communication device, a computer, a wireless communication device, a portable electronic device, a mobile electronic device or a mobile phone.

According to a third aspect of the invention, a method for absorbing sound waves radiated from a rear side of a diaphragm of a loudspeaker, comprises: providing an acoustic signal in forward and backward directions by a way of vibrations of the diaphragm of the loudspeaker; and absorbing the sound waves radiated from a rear side of the diaphragm in a backward direction using a sound sponge block comprising multiple ducts made of a pre-selected material placed behind the diaphragm without physically touching the diaphragm, wherein the multiple ducts have predetermined geometrical dimensions to substantially absorb the sound waves.

According further to the third aspect of the invention, the multiple ducts may be round cylinders. Further, the round cylinders may have a diameter between 0.1 and 10 microns.

Further according to the third aspect of the invention, the ends of the multiple ducts furthest from the diaphragm may be sealed and have an infinite specific termination impedance.

Still further according to the third aspect of the invention, the multiple ducts may be parallel to each other.

According further to the third aspect of the invention, the multiple ducts may be substantially perpendicular to a surface of the diaphragm.

According still further to the third aspect of the invention, a cross section of the multiple ducts may comprise 90% or less of a total cross section area of the sound sponge block.

According yet further still to the third aspect of the invention, a sound sponge block may have a real part of an acoustic impedance substantially constant in a predetermined frequency range. Further, the frequency range may be from 10 Hz to 10,000 Hz.

BRIEF DESCRIPTION OF THE DRAWINGS

For a better understanding of the nature and objects of the present invention, reference is made to the following detailed description taken in conjunction with the following drawings, in which.

MODES FOR CARRYING OUT THE INVENTION

Figure 1A:
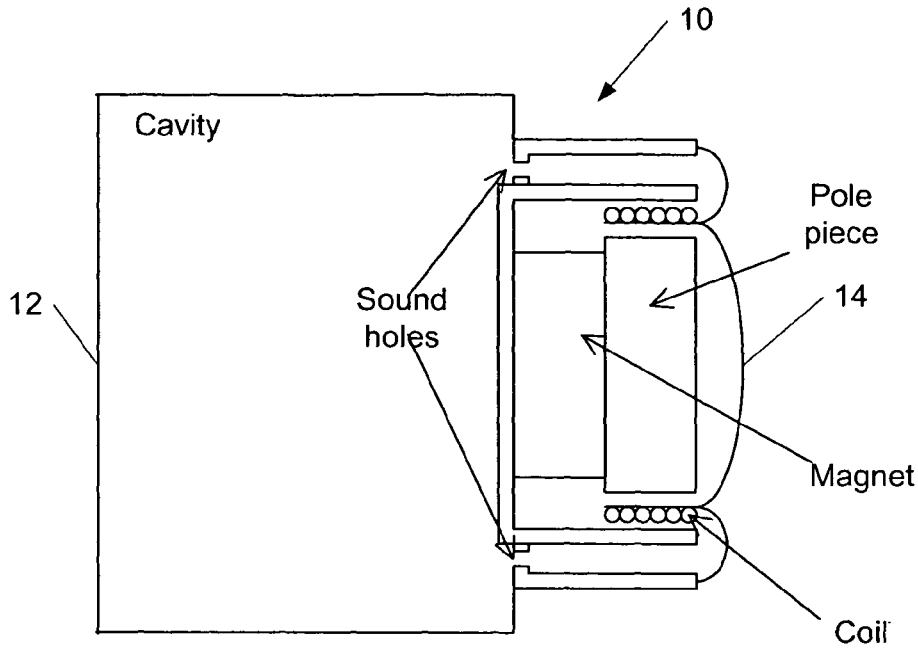
FIGS. 1*a* and 1*b* are schematic representations of electrodynamic loudspeakers: a) according to prior art, and b) with a sound sponge block, according to an embodiment of the present invention.

A new method and apparatus are presented for reducing loudspeaker size by partitioning the back cavity of the loudspeaker using a sound sponge block. According to an embodiment of the present invention, this sound sponge block is an array of narrow ducts (e.g., parallel ducts, or parallel round cylinders of a small diameter) made of a pre-selected material with predetermined dimensions (e.g., the diameter and length) formed within a single block which is placed behind a loudspeaker diaphragm (also called a membrane), but not actually in a direct contact with it. The ducts can be made of a rigid etchable material such as (but not limited to) metal, plastic, glass, silicon or ceramic. Typically, the diaphragm provides an acoustic signal by a way of vibration in forward and backward directions and the sound sponge block, comprising the multiple ducts, substantially absorbs the sound waves radiated from a rear side of the diaphragm in the backward direction due to significant drop in impedance for very narrow tube diameters. Very narrow ducts (e.g., with duct diameters on the order of a micron, for example, from 0.1 to 10 microns) slow down the speed of sound so they effectively behave like much longer ducts. It is noted that for round duct diameters of 100 μm, 10 μm, and 1 μm, the wave propagation speeds of sound are 33 m/s, 3.3 m/s and 0.33 m/s, respectively. The reduction in the propagation speed explains the eventual drop in the impedance for very narrow tube diameters.

In one embodiment, the axes of the ducts can be substantially parallel with the axis of the diaphragm (i.e., the ducts are perpendicular to the surface of the plane diaphragm). Dimensions of the ducts (e.g., the diameter and length) are optimized to absorb the sound radiated from the rear side of the diaphragm, rather than blocking it, and to damp out the vibration modes of the diaphragm. The ends of the ducts furthest from the diaphragm can be sealed (blocked) and have infinite specific termination impedance typically using the same material as the ducts themselves. The absorption is achieved through viscous boundary losses and thermal conduction. A single cavity provides mainly stiffness which opposes the motion of the diaphragm and therefore has to be large in order to minimize the stiffness. As the cavity is divided into parallel ducts, the sound wave is slowed down by the viscous and thermal losses so that the impedance falls and becomes mainly resistive which allows to effectively control the diaphragm's resonant modes. Hence the overall cavity space can be greatly reduced.

Implementation of the loudspeakers with the sound sponge in mobile devices (e.g., mobile phones) is fairly straightforward since the loudspeaker's back cavity is simply eliminated and replaced with the sound sponge block which is integral to the loudspeaker, according to embodiments of the present invention. The total volume of the loudspeaker system then can be rather small (e.g., about two to three cubic centimeters).

The loudspeaker with the sound sponge (acoustic absorber) can be used in a variety of electronic devices, which can include (but are not limited to): communication devices, computers, wireless communication devices, portable electronic devices, mobile electronic devices, a mobile phone, etc.

The main advantage of the sound sponge is that it enables the use of high-efficiency high-quality (i.e. low-distortion and flat frequency response) membrane type loudspeakers in small spaces. Current mobile loudspeaker designs are typically 0.01% efficient. The sound sponge allows to absorb the lower frequency waves which cannot be accomplished with the prior art sound absorbing porous materials in which the pores are essentially random in size.

If a transparent version is developed (e.g., the diaphragm is made of optically transparent material), the loudspeaker can be combined with a display of the electronic device, e.g., the loudspeaker could be mounted directly in front of a display and would therefore open up all kinds of industrial design possibilities. Due to the increased efficiency, WLAN (wireless local area network) loudspeakers, for use with music playing phones, could be produced as well. These loudspeakers could run from batteries that would last for a long time.

Figure 1B:
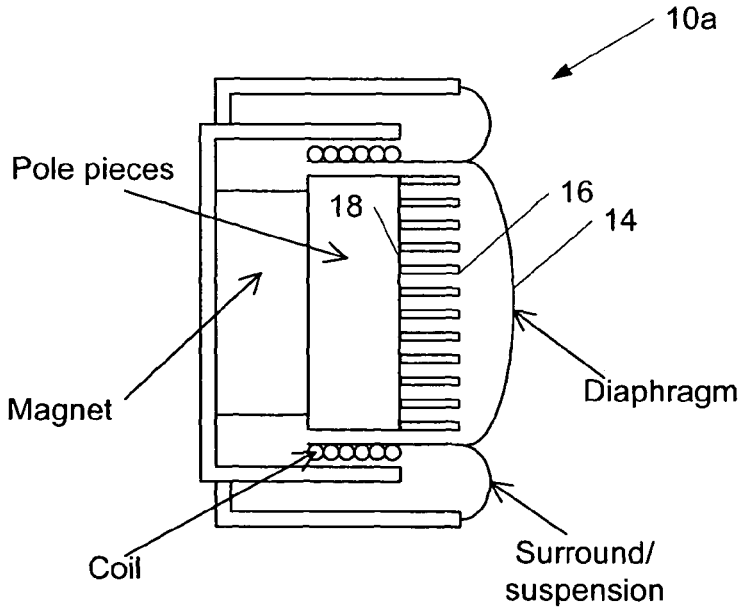

FIGS. 1*a* and 1*b* show examples among others of schematic representations of electrodynamic loudspeakers 10 and 10*a*: a) according to the prior art, and b) with a sound sponge block 18, according to an embodiment of the present invention. Instead of using a cavity as in the prior art case shown in FIG. 1*a*, a sound sponge block 18 with multiple parallel round ducts 16 is used for absorbing backward waves radiated by the loudspeaker diaphragm 14 in a backward direction, according to embodiments of the present invention. The ends of the ducts 16 furthest from the diaphragm 14 are sealed (blocked) and have infinite specific termination impedance.

Figure 2A:
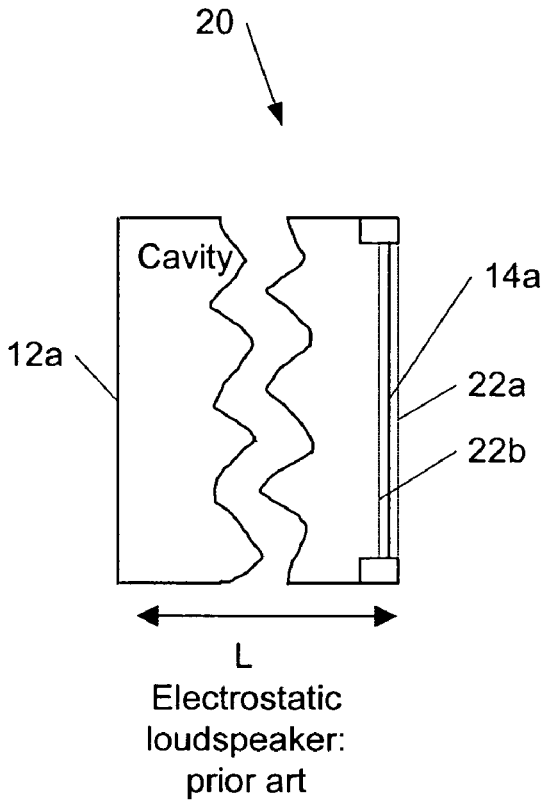
FIGS. 2*a* and 2*b* are schematic representations of electrostatic loudspeakers: a) according to prior art, and b) with a sound sponge block, according to an embodiment of the present invention.
Figure 2B:
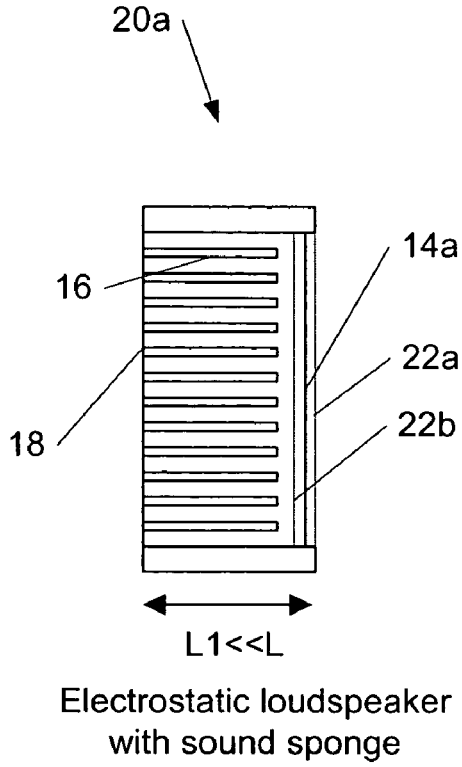

FIGS. 2*a* and 2*b* show examples among others of schematic representations of electrostatic loudspeakers 20 and 20*a*: a) according to the prior art, and b) with a sound sponge block 18, according to an embodiment of the present invention. In the prior art case shown in FIG. 2*a*, a large continuous enclosed cavity 12*a* is needed for reduction/cancellation of the backward wave effects, which unfortunately reduces the bass response of the loudspeaker 20. Instead of using the large cavity 12*a* as in the prior art case shown in FIG. 2*a*, the sound sponge block 18 with multiple parallel round ducts 16 is used in a partitioned cavity design with much smaller dimensions ($L1 \ll L$) for absorbing backward waves radiated by the loudspeaker flat diaphragm 14*a* (with electrodes 22*a* and 22*b* close to the surfaces of the diaphragm 14*a*), in a backward direction, according to embodiments of the present invention. This results in a small partitioned cavity with no bass loss. The ends of the ducts 16 furthest from the diaphragm 14*a* are also sealed (blocked) thus having infinite specific termination impedance. It is noted that if the diaphragm 14*a* and the electrodes 22*a* and 22*b* are made of the optically transparent materials (e.g., the electrodes can be made of a conducting material such as metal or a non-conductive clear plastic with a conductive transparent coating such as indium tin oxide), the loudspeaker 20*a* can be combined with a display of the electronic device, as discussed above.

Figure 3:
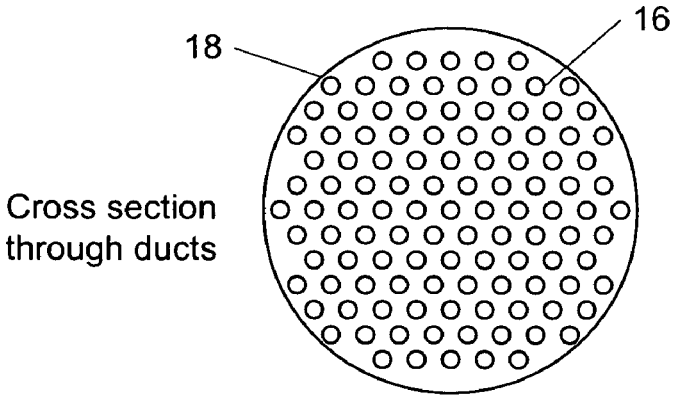
FIG. 3 is a cross section of a sound sponge block, according to an embodiment of the present invention.

FIG. 3 is an example among others of a cross section of a sound sponge block 18, according to an embodiment of the present invention. The ducts 16 are round cylinders of a small diameter (typically on the order of microns, e.g., from 0.1 to 10 microns), however, the various embodiments of the present invention can be applied to ducts of larger diameters as well. The filling factor of such ducts 16 should be as high as practically possible in order to minimize the impedance. For example, the filling factor of ½ (i.e., half of the cross sectional area of the block 18 comprises the ducts 16) doubles the specific acoustic impedance. For the filling factor of ⅓ (i.e., one third of the cross sectional area of the block 18 comprises the ducts 16) triples the specific acoustic impedance.

Figure 4A:
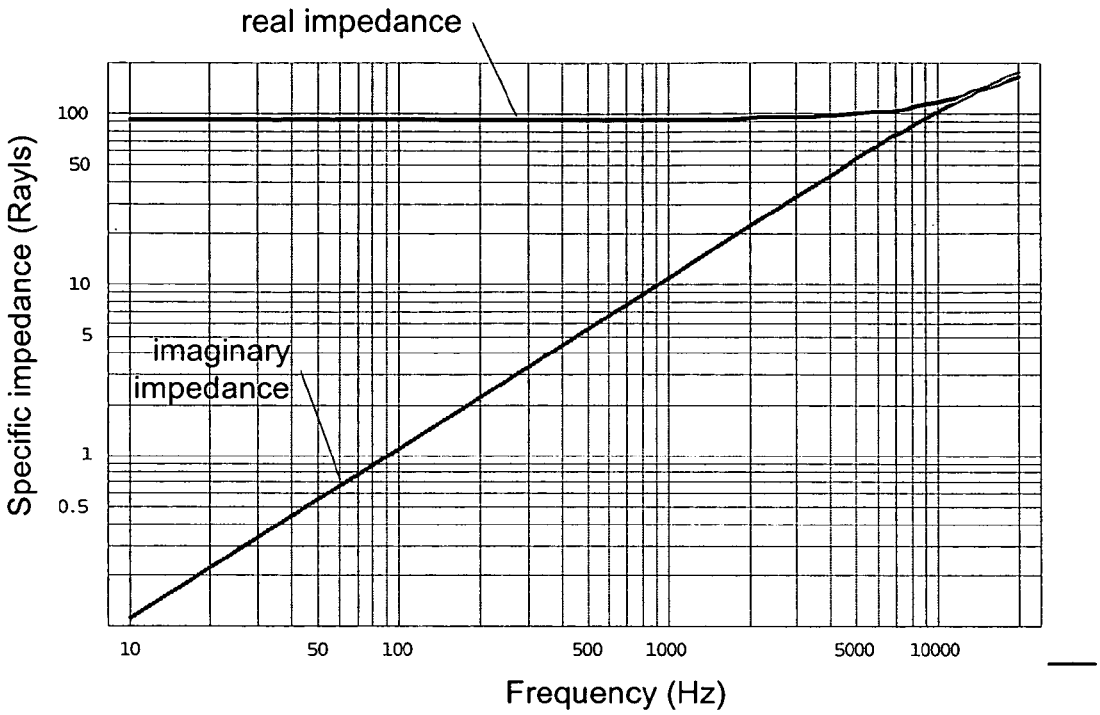
FIGS. 4*a* and 4*b* are graphs of simulated results for a specific acoustic impedance as a function of frequency of a sound sponge block for: a) round ducts of 1 μm in diameter and 100 μm long with a filling factor of ½ and b) round ducts of 1.5 μm in diameter and 500 μm long with a filling factor ½, according to embodiments of the present invention.
Figure 4B:
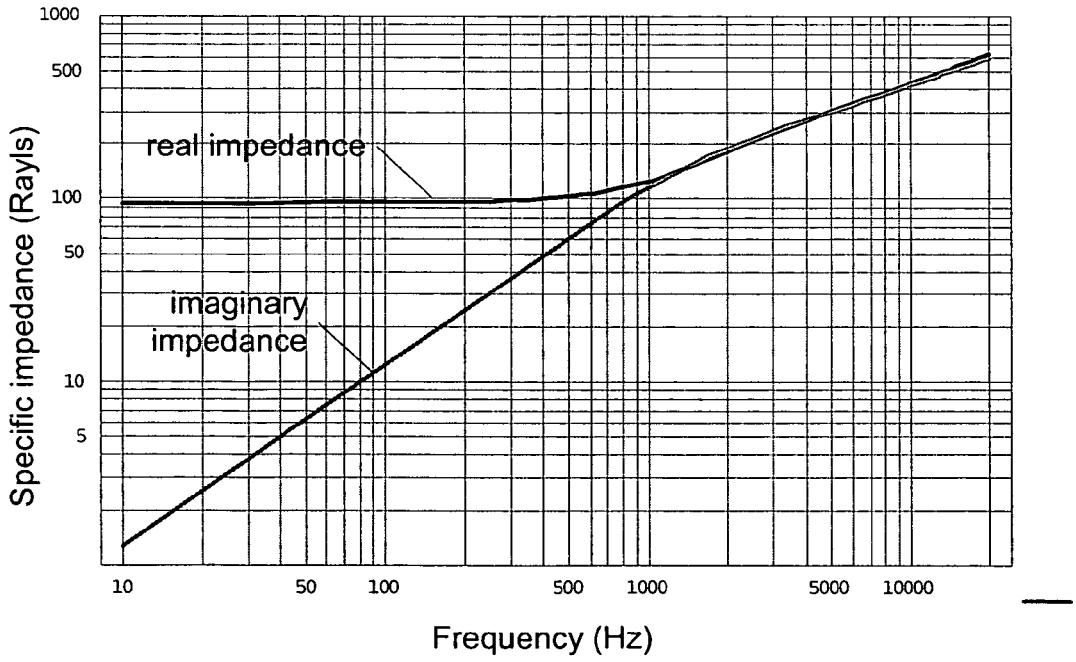

FIGS. 4*a* and 4*b* are examples among others of graphs of simulated results for the specific acoustic impedance as a function of frequency of a sound sponge block 18 for: a) round ducts of 1 μm in diameter and 100 μm long with a filling factor of one half and b) round ducts of 1.5 μm in diameter and 500 μm long also with a filling factor of one half, according to embodiments of the present invention. The dominant resistive impedance of 90-100 Rayls shown in FIG. 4*a* is fairly optimum in a broad (e.g., predetermined) frequency range (e.g., from 10 Hz to about 10,000 Hz) especially for an electrostatic loudspeaker 20*a* shown in FIG. 2*b*, because it provides good damping of the diaphragm vibration modes but does not attenuate the acoustic output in the forward direction. The analysis shows that the duct diameter cannot be increased too much further. If it is increased, the duct length has to be increased to achieve the same impedance at 10 Hz, which results in rising the impedance at higher frequencies as shown in FIG. 4*b* (typically the rising impedance is proportional to the square root of the frequency). The results are for the sound sponge with a filling factor of ½.

The simulated results of FIGS. 4*a* and 4*b* were generated using expressions derived by M. R. Stinson in "The Propagation of Plane sound Waves in Narrow and Wide Circular Tubes, and Generalization of Uniform Tubes of Arbitrary Cross-Sectional Shape", published in Journal of Acoustical Society of America, 89(2), pages 550-558 (1991). The specific impedance can be calculated by applying equations 43 and 45 of Stinson for the wave number and average velocity respectively to a tube with one end blocked (with the infinite specific termination impedance $z_T=\infty$) as follows:

$$Z_1|_{z_T=\infty} \approx i z_0 \cot kL \tag{1}$$

wherein $$z_0 \approx -\frac{\omega\rho}{k}\left(1-\frac{2J_1\left(a\sqrt{k_V^2-k^2}\right)}{k_V a J_0\left(a\sqrt{k_V^2-k^2}\right)}\right)^{-1}, \tag{2}$$

$$k \approx \frac{\omega}{c}\sqrt{\left(1+\frac{2(\gamma-1)J_1(k_T a)}{k_T a J_0(k_T a)}\right)\left(1+\frac{2J_1(k_V a)}{k_V a J_0(k_V a)}\right)^{-1}}, \tag{3}$$

$$k_T \approx \sqrt{-\frac{i\omega\rho c^2}{(\gamma-1)\kappa T_0}}, \tag{4}$$

$$k_V \approx \sqrt{-\frac{i\omega\rho}{\mu}}, \tag{5}$$

wherein a is a radius of a duct cylinder, L is its length, k is the wave number of a sound wave, μ is the duct media viscosity, γ is the ratio of specific heats at constant pressure and constant volume ($C_p/C_v$) of the duct media, κ is the thermal conductivity of the duct media, ρ is the duct media density, $T_0$ is the absolute static temperature, c is the free space speed of sound in the duct medium, $J_0$ and $J_1$ are zero and first order Bessel functions.

In case of the very narrow ducts (a→0), the Equation 1 is simplified as follows:

$$Z_l|_{z_T=\infty, a\to 0} \approx -i z_0' \cot\frac{2L}{ac}\sqrt{\frac{\gamma\mu\omega}{i\rho}}, \tag{6}$$

wherein $$z_0'|_{a\to 0} \approx -\frac{a\rho c}{4}\sqrt{\frac{2i\omega\rho}{\gamma\mu}}\left(1-\sqrt{1-8\gamma\left(\frac{\mu}{a\rho c}\right)^2}\right)^{-1}. \tag{7}$$

Figure 5:
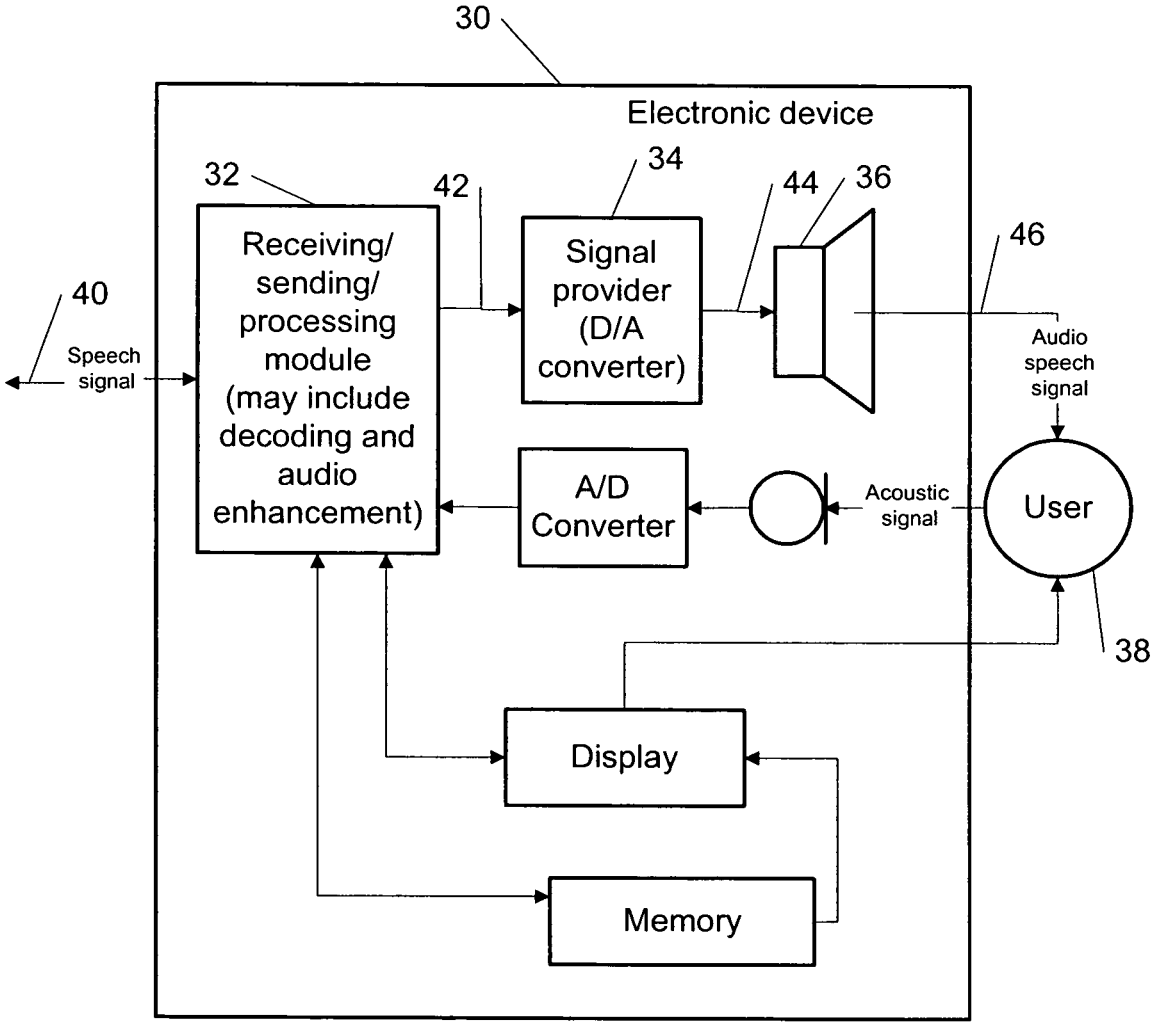
FIG. 5 is a block diagram of an electronic device comprising a loudspeaker with a sound sponge, according to an embodiment of the present invention.

FIG. 5 shows an illustrative example among many others of a block diagram of an electronic device 30 comprising a loudspeaker 36 with a sound sponge block, according to an embodiment of the present invention. The electronic device 30 can be (but is not limited to), e.g., a communication device, a wireless communication device, a portable electronic device, a mobile electronic device, a mobile phone, a computer, etc.

A receiving/sending/processing module 32 (which can include, besides receiver, transmitter, CPU, etc., also decoding and audio enhancement means) receives or sends a speech signal 40. When the speech signal 40 is received, the block 32 generates the received signal 42 which is further provided to the user 38 as an audio speech signal (i.e., an electric drive signal) 46 using a signal provider (digital-to-analog (D/A) converter) 34 and a speaker 36. Also, the electronic device 30 comprises other standard blocks such as display, memory and a microphone for providing an electronic signal in response to an acoustic signal generated by the user 38 (the electronic signal is further provided to the block 32 for sending the speech signal 40 to the outside addressee). According to an embodiment of the present invention, the loudspeaker 36 can be implemented as a separate block, or it can be combined with any other standard block of the electronic device 30. For example, the loudspeaker 36 can be combined, as discussed above, with the display of the electronic device 30, if the loudspeaker 36 is implemented in the transparent version, e.g., with transparent diaphragm 14*a* and electrodes 22*a* and 22*b* in the electrostatic implementation as shown in FIG. 2*b*. Then the loudspeaker 36 could be mounted directly in front of a display.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A sound sponge block, comprising:

multiple ducts made of a pre-selected material, said multiple ducts being substantially equal in length and having predetermined geometrical dimensions, configured to substantially absorb the sound waves from a rear side of a diaphragm in a backward direction when said sound sponge block is placed behind said diaphragm without physically touching said diaphragm, wherein said diaphragm is configured to provide an acoustic signal by a way of vibrations in forward and backward directions.

2. The sound sponge block of claim 1, wherein said multiple ducts are round cylinders.

3. The sound sponge block of claim 2, wherein said round cylinders have a diameter between 0.1 and 10 microns.

4. The sound sponge block of claim 1, wherein ends of said multiple ducts furthest from the diaphragm are sealed and have an infinite specific termination impedance.

5. The sound sponge block of claim 1, wherein said multiple ducts are parallel to each other.

6. The sound sponge block of claim 1, wherein said multiple ducts are substantially perpendicular to a surface of said diaphragm.

7. The sound sponge block of claim 1, wherein a cross section of said multiple ducts comprise 90% or less of a total cross section area of said sound sponge block.

8. The sound sponge block of claim 1, wherein the sound sponge block has a real part of an acoustic impedance substantially constant in a predetermined frequency range.

9. The sound sponge block of claim 8, wherein predetermined said frequency range is from 10 Hz to 10,000 Hz.

10. The sound sponge block of claim 1, wherein ends of said multiple ducts furthest from the diaphragm are sealed and have an infinite specific termination impedance.

* * * * *